US006029481A

United States Patent [19]

Lai

[11] Patent Number: 6,029,481

[45] Date of Patent: Feb. 29, 2000

[54] COMBINATION PADLOCK CONSTRUCTION WITH MANUAL ACTIVATION

[75] Inventor: Eric Lai, Sheung Shui, The Hong Kong Special Administrative Region of the People's Republic of China

[73] Assignee: The Sun Lock Company, The Hong Kong Special Administrative Region of the People's Republic of China

[21] Appl. No.: 09/219,910

[22] Filed: Dec. 23, 1998

[51] Int. Cl.[7] ..... E05B 37/02

[52] U.S. Cl. ..... 70/25; 70/51

[58] Field of Search ..... 70/312, 22–30, 70/51

[56] References Cited

U.S. PATENT DOCUMENTS

| | | | |
|---|---|---|---|
| Re. 29,277 | 6/1977 | Harrington et al. . | |
| 1,187,837 | 6/1916 | Hook et al. | 70/28 |
| 1,293,879 | 2/1919 | Neumann | 70/29 |
| 1,823,650 | 9/1931 | Gordon . | |
| 2,008,565 | 7/1935 | Segal . | |
| 2,220,148 | 11/1940 | Eber . | |
| 3,386,271 | 6/1968 | Morin . | |
| 3,983,724 | 10/1976 | Foote . | |
| 4,111,014 | 9/1978 | Epstein . | |
| 4,671,084 | 6/1987 | Lin . | |
| 5,042,277 | 8/1991 | Jenn-Rong | 70/28 |
| 5,715,709 | 2/1998 | Lai | 70/25 |

*Primary Examiner*—Darnell M. Boucher
*Attorney, Agent, or Firm*—Melvin I. Stoltz

[57] ABSTRACT

By providing a separate and independent release assembly having independent activation means for controlling the release or opening of a combination lock, an effective, easily produced, combination lock is achieved. The combination lock of the present invention virtually eliminates the ability of unauthorized persons from opening the lock, using known picking techniques, while also being constructed with the interior chambers thereof virtually sealed from ambient surroundings, preventing unwanted contamination from entering the interior of the lock and the rotating components thereof. In addition, a minimum number of components are employed in combination with a housing and a movable shackle which is completely controlled by a separate and independent shackle release assembly having an independent activation member. In this way, the unique combination padlock construction of this invention is achieved.

21 Claims, 6 Drawing Sheets

COMBINATION PADLOCK CONSTRUCTION WITH MANUAL ACTIVATION

TECHNICAL FIELD

This invention relates to combination locks, and, more particularly, to combination lock constructions having a high degree of security and dependability.

BACKGROUND ART

Numerous lock constructions have been developed and are widely employed by individuals to prevent unauthorized persons from gaining access to any area which has been closed and locked. Although many locks are constructed to be opened by a key, numerous combination locks have been developed which are opened by knowledge of a particular combination.

One particular type of combination lock that has become very popular due to its ease and convenience of use is a combination lock which employs a plurality of rotatable independent dials, each of which forms one of the indicia, usually numerals or letters, comprising the combination for releasing the lock. Although locks of this general nature have been available for several decades, these prior art combination lock constructions suffer from common deficiencies which have not been successfully overcome.

Although many manufacturers have attempted to solve the problems associated with rotatable dial or combination locks, these prior art constructions have been unable to produce a construction which eliminates the ability of unauthorized persons discovering the combination for opening the lock. Although numerous attempts have been made in prior art constructions for achieving a system which would eliminate or prevent unauthorized opening or picking of a lock, these prior art constructions have failed to provide the desired results.

Another common problem which has consistently plagued prior art constructions is the cost of construction for producing and assembling prior art combination locks. In order to attain a combination lock which provides all of the features desired by consumers, prior art constructions typically incorporate numerous small components, each of which require expensive assembly procedures to produce the final product. As a result, these prior art lock constructions typically are expensive to produce, thereby reducing the ability of these locks to reach a broad base of consumers.

In addition, in many combination lock constructions, the shaft of the shackle forms an integral part of the release systems of the lock assembly. As a result, unauthorized individuals using known techniques are able to use this shackle-lock construction to "pick" the lock and gain unauthorized access to the material which was being protected.

A further problem commonly found with prior art combination locks is the inability of these prior art constructions to prevent contaminants from reaching the rotatable, internal components of the lock, thereby causing damage to these components or interfering with the ease of operating the lock by an individual knowing the actual combination. Although numerous attempts have been made to reduce the adverse effects caused by contaminants reaching these components, such attempts have been incapable of completely eliminating this problem.

Therefore, it is a principal object of the present invention to provide a combination lock construction which virtually eliminates the ability of unauthorized persons from gaining access to the lock by attempting to pick the lock using known techniques.

Another object of the present invention is to provide a combination lock having the characteristic features described above which employs a minimum of components and is quickly and easily assembled, thereby providing a lock capable of being constructed at a competitive price.

Another object of the present invention is to provide a combination lock construction having the characteristic features described above which effectively seals the rotating components from external contamination and effectively prevents any external contaminants from reaching the rotating components thereof.

Other and more specific objects will in part be obvious and will in part appear hereinafter.

SUMMARY OF THE INVENTION

By employing the present invention, all of the difficulties and drawbacks of the prior art constructions are virtually eliminated and an effective, easily produced, combination lock is achieved which incorporates a separate and independent release assembly having independent activation means for controlling the lock release or opening. In this way, the padlock or combination lock of the present invention virtually eliminates the ability of unauthorized persons from opening the lock, using known picking techniques, while also being constructed with the interior chambers thereof virtually sealed from ambient surroundings, preventing unwanted contamination from entering the interior of the lock and the rotating components thereof. In this way, the prior art degradation and interference of the lock operation by contamination or unauthorized openings are virtually eliminated.

In accordance with the present invention, a minimum number of components are employed in combination with a housing and a movable shackle which is completely controlled by a separate and independent shackle release assembly having an independent activation member. In this way, the unique combination padlock construction of this invention is achieved. In addition to the shackle, housing, and shackle release assembly, only a plurality of rotating dials and a plurality of tumbler sleeves are required to provide the desired locking mechanism. Using the present invention, it has been found that a high level of security is attained, with locked items remaining locked and incapable of access by unauthorized personnel, with three dials and tumbler sleeves being employed with the housing. However, if desired, four or any desired number of dial and tumbler sleeves may be employed without departing from the scope of this invention.

As is well known in the lock industry, individuals seeking to pick or open a lock without knowledge of the combination use an axial force on the shackle leg in combination with rotation of the dials to assist such individuals to determine when the tumbler enters the open chamber for being properly aligned therewith. By simultaneously rotating a dial and exerting an axial force on the shackle leg, such trained individuals are capable of determining when the requisite or proper position is reached for each tumbler, without knowledge of the actual combination.

In the present invention, the ability of unauthorized persons to determine the actual combination using axial forces on the shackle leg is totally eliminated by incorporating a separate and independent shackle release assembly which is interconnected to the dials and tumblers. By employing the construction of the present invention, the shackle is separated from the dials and tumblers and, as a result, the ability of trained individuals to pick the lock of this invention is virtually eliminated.

In the preferred construction, a separate and independent shaft is mounted in the housing of the combination lock of this invention comprising the rotatable dials and tumblers mounted therein. In addition, the housing incorporates an elongated lock release groove or slot which provides the lock release zone for each of the independent rotatable tumbler sleeves. When the tumblers are placed in the proper position, the shaft and tumbler are able to axially move relative to the housing. In the preferred construction, this axial movement is controlled by lock release means, which simultaneously causes the shackle to be released and the padlock opened.

In addition, in the preferred construction, all of the rotatable components are mounted in a single elongated bore formed in the housing which is positioned separately and independently from the shackle and its locking member. As a result, ease of assembly is attained and, once assembly is completed, the elongated bore and the rotational components positioned therein are effectively sealed in a remote location from external contamination. As a result, dirt, dust, debris, etc., commonly present in the environment, is eliminated from contaminating the working components of the combination lock of this invention. In this way, contamination from environmental sources which has often caused prior art lock assemblies to become defective is essentially overcome.

In addition to these features, the present invention achieves a combination lock using a minimum number of independent components each of which is capable of being quickly assembled into the final product. As a result, a construction is attained which is capable of being manufactured at a competitive price, while providing a high quality, highly effective combination lock which prevents exposure to environmental contamination and also incorporates means for virtually eliminating unauthorized persons from opening the lock without knowledge of the combination.

The invention accordingly comprises an article of manufacture possessing the features, properties, and the relation of elements which will be exemplified in the article hereinafter described and the scope of the invention will be indicated in the claims.

THE DRAWINGS

For a fuller understanding of the nature and objects of the invention, reference should be had to the following detailed description taken in connection with the accompanying drawings, in which.

DETAILED DESCRIPTION

Figure 2:
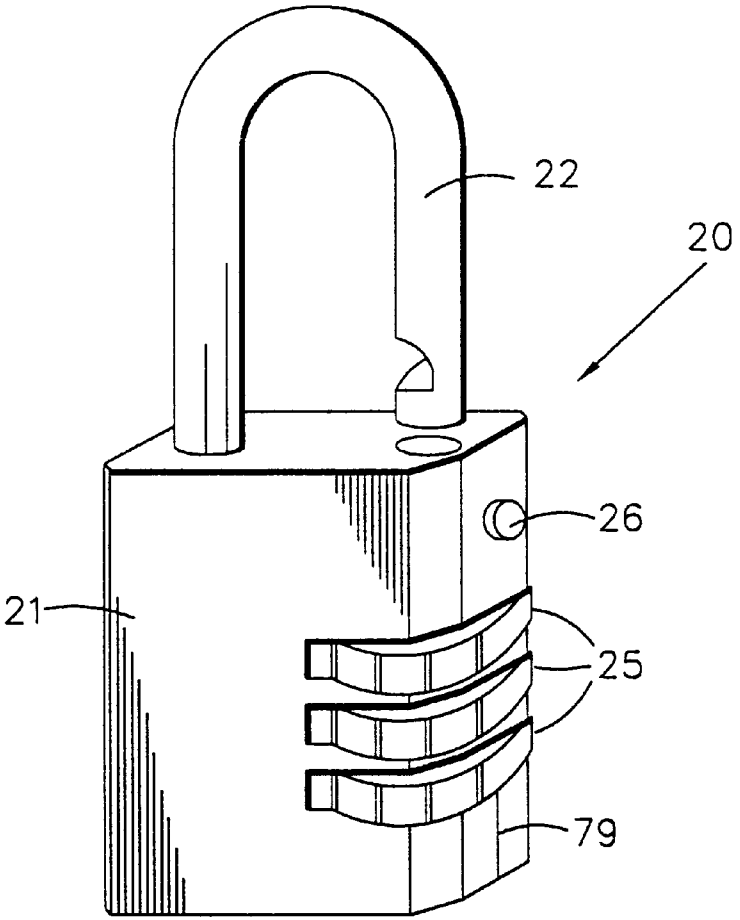
FIG. 2 is a perspective view of the combination lock of FIG. 1 shown in its open, unlocked position.
Figure 1:
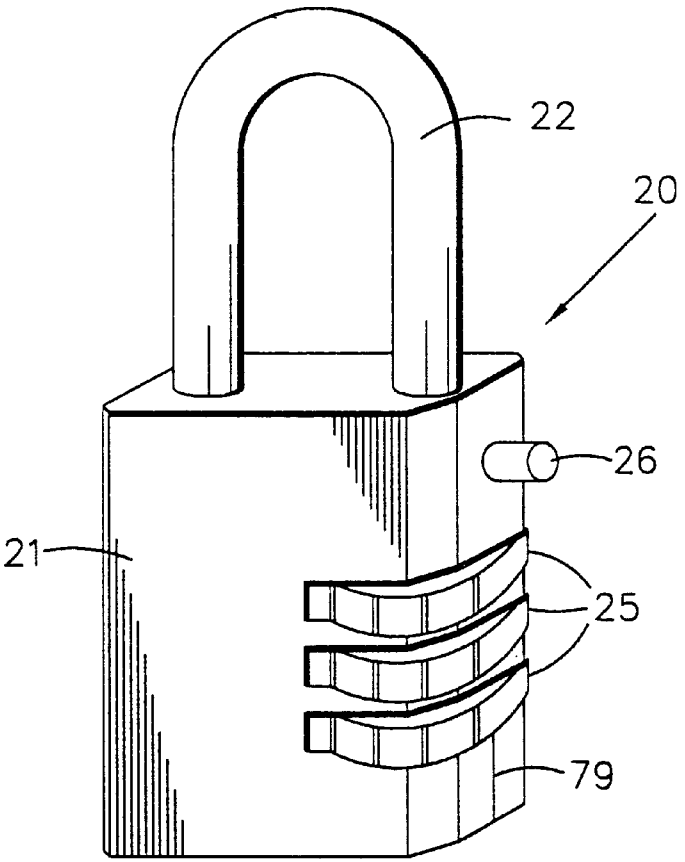
FIG. 1 is a perspective view of one embodiment of the combination lock of the present invention shown fully assembled and in its locked position.

By referring to FIGS. 1–8, along with the following detailed disclosure, the construction and operation of combination lock 20 of the present invention can best be understood. In the drawings and the following detailed disclosure, two preferred embodiments of the present invention are fully disclosed. However, the present invention can be implemented using further alternate constructions, which alternate constructions are intended to be within the scope of the present invention. Consequently, the embodiments detailed herein are provided for exemplary purposes with no intention of being specifically limited thereto.

As shown in FIGS. 1–8, combination lock 20 of the present invention is constructed using a minimum of principal components, thereby substantially reducing the complexity found in most prior art combination locks. In this way, the present invention provides a highly effective, commercially desirable construction capable of being produced at a competitive cost, while providing all of the locking and theft deterrent features typically incorporated in prior art combination locks and substantially enhancing and improving upon these prior art features.

In the present invention, the principal components comprise a central housing 21, a shackle 22, a shaft 23, three separate and independent tumbler sleeves 24, three separate and independent rotatable dials 25, shaft activation means 26 and shackle release member 27. By employing these principal components, in the unique manner detailed herein, an easily produced, highly effective combination lock 20 is attained.

In the preferred construction as best seen in FIGS. 5–8, housing 21 comprises a single, unitary member which incorporates two parallel, elongated bores or channels 28 and 29 formed therein and extending substantially the entire length of housing 21. As is fully detailed below, bore 28 retains shaft 23, while bore 29 contains one leg of shackle 22. In addition, housing 21 comprises holding cavity 37 cooperatively associated with bore 28 and constructed for retaining shaft activation means 26 and shackle release member 27.

Each tumbler sleeve 24 comprises a generally cylindrical shape incorporating a single locking fin 30 radially extending from outer, circular-shaped surface 31. In addition, each tumbler sleeve 24 also comprises an inside, circular-shaped surface 32 which is coaxially aligned with outside surface 31. The diameter of inside surface 32 of tumbler sleeve 24 is constructed to enable each tumbler sleeve 24 to freely pivot about the outer surface of shaft 23.

Each dial 25 is constructed for peripherally surrounding and cooperating with a tumbler sleeve 24. In this regard, each dial 25 comprises two separate and distinct, circular-shaped inside surfaces 33 and 34. Inside surface 33 comprises a diameter slightly greater than the diameter of outside surface 31 of tumbler sleeve 24, in order to enable tumbler sleeve 24 and dial 25 to cooperate with each other while being independently rotationally movable about shaft 23.

In addition, each dial 24 comprises a plurality of slots 35 formed in inside surface 33, with each slot being constructed for receiving and retaining radially extending fin 30 of tumbler sleeve 24. In this way, whenever radially extending fin 30 is mounted in a slot 35 of dial 25, tumbler sleeve 24 and dial 25 are in interlocked engagement, causing both members to rotate together about shaft 23.

The number of slots 35 formed in dial 25 corresponds to the number of separate and distinct indicia formed on the outer surface of dial 25. In the preferred embodiment, ten indicia are employed on the outside surface of dial 25 and ten slots 35 are formed in surface 33.

Inside surface 34 of dial 25 comprises a circular shape formed by a diameter which is aligned with the axis of surface 33, but is greater than the length of fin 30. In this way, when fin 30 is disengaged from slot 35 of dial 25, dial 25 is able to rotate about shaft 23 independently of tumbler sleeve 24.

In the preferred construction, shaft 23 is mounted in bore 28 of housing 21 for axial movement relative thereto. In the preferred embodiment, shaft 23 is movable between a first locking position and a second releasing position. Furthermore, shaft 23 comprises an overall length which is greater than the length of bore 28 of housing 21 within which shaft 23 is retained. As a result, one end of shaft 23 protrudes from bore 28 regardless of which position shaft 23 is placed. In addition, each tumbler sleeve 24 is rotationally mounted to shaft 23 of shackle 22, with each tumbler sleeve having a dial 25 rotationally associated therewith.

As discussed above, each dial 25 has a plurality of indicia formed on the outer peripheral surface thereof, each of which represents one component of the combination for positioning tumbler sleeves 24 in the requisite location for releasing shackle 22. Although any desired indicia can be employed, numerals or letters are typically employed. In the present invention, each dial 25 comprises an outer surface 44 on which ten panels 45 are formed with slots 46 separating each panel 45. In addition, one numeral ranging from 0, 1, 2, 3, 4, 5, 6, 7, 8 and 9 is formed on each panel 45. The numeral in each panel 45 of each dial 25 is then employed to define the selectable combination for lock 20.

In order to complete the construction of this embodiment of the present invention, spring means 50 is mounted in the base of elongated bore 29 for assisting in controlling the movement of shackle 22 when shackle 22 has been released. Furthermore, in order to control the axial movement of shackle 22 in bore 29 between its two alternate positions, pin means 51 is formed in housing 21 and positioned in cooperating relationship with relief or cut-away section 52 of shackle 22.

Figure 5:
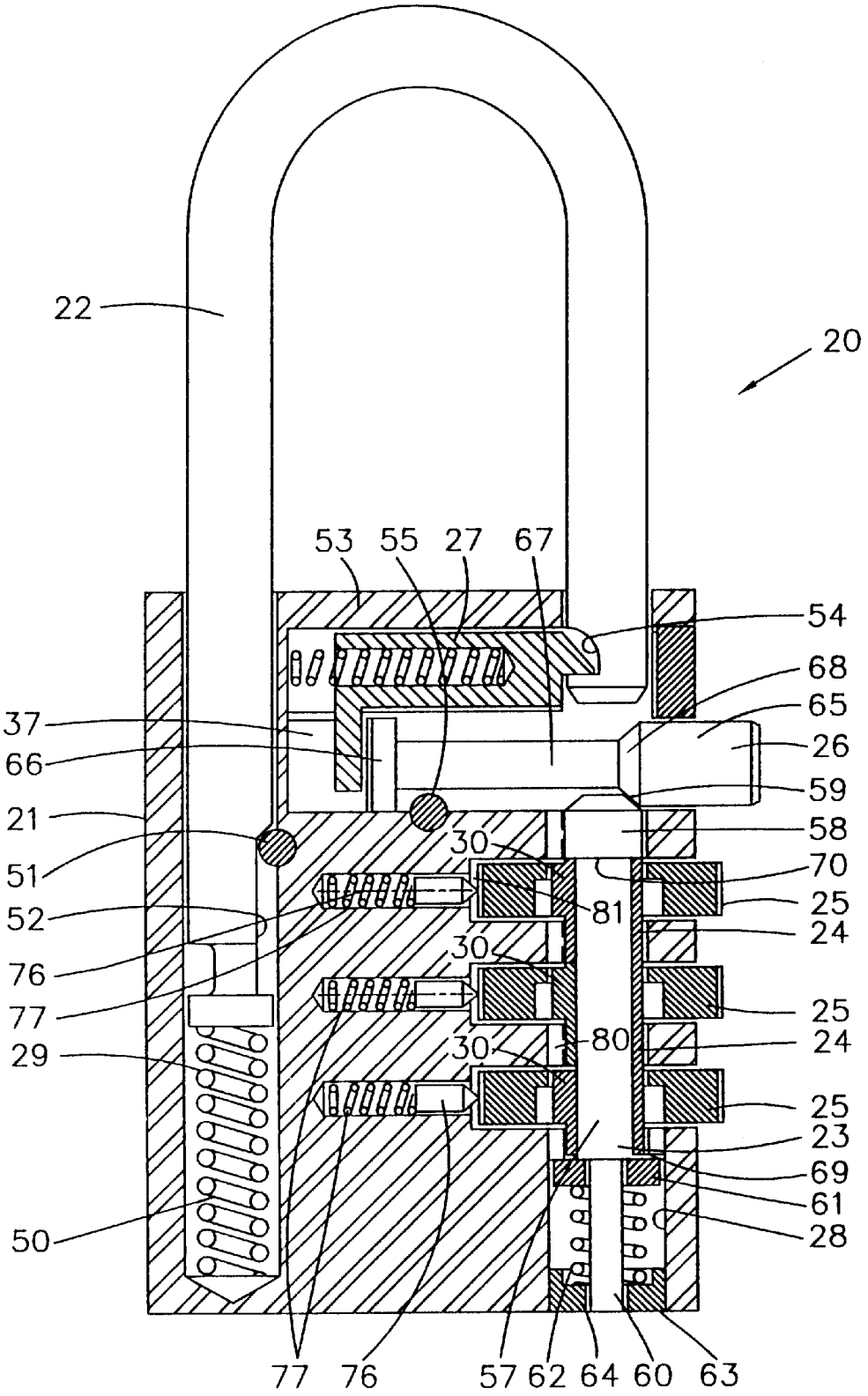
FIG. 5 is a front elevation view, partially in cross-section, depicting the fully assembled combination lock of FIG. 1 in its normal operating and locked position.
Figure 6:
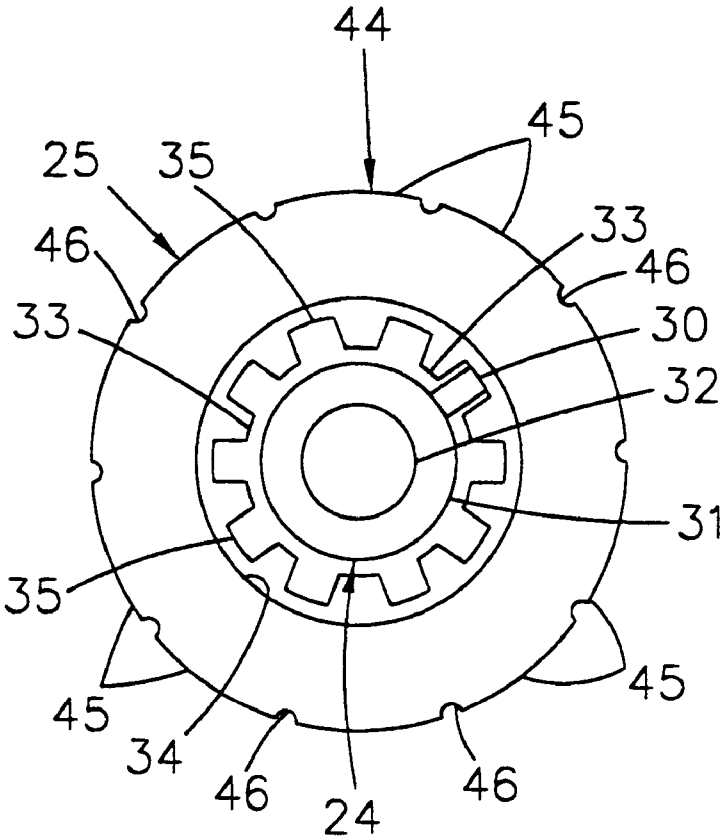
FIG. 6 is a bottom plan view of one rotating dial with one rotating tumbler sleeve interengaged therewith.
Figure 7:
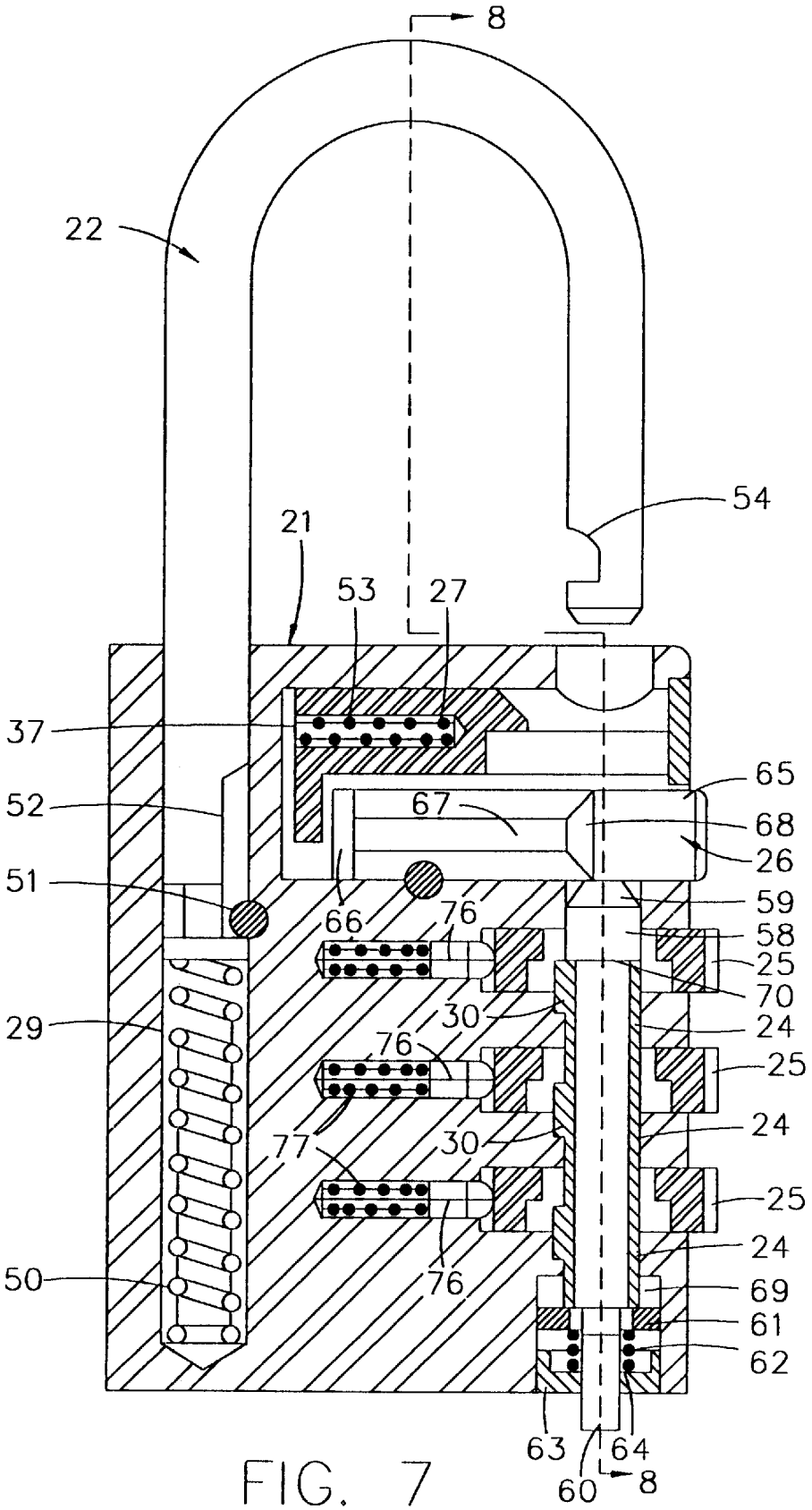
FIG. 7 is a front elevation view, partially in cross-section, depicting the combination lock of FIG. 1 in its unlocked and combination re-setting position.

As is evident from a review of FIGS. 5 and 7, when shackle 22 is in its fully engaged and locked position, pin means 51 abuts one end of cut-away section 52, while pin 51 abuts the opposed end of cut-away section 52 when shackle 22 is released and forced upwardly by spring means 50, as depicted in FIG. 7. By employing this construction, the desired controlled, limited movement of shackle 22 relative to housing 21 is easily and efficiently attained.

As also shown in FIGS. 5 and 7, a similar construction is employed to control the movement of shaft activation means 26 and shackle release member 27. In this preferred construction, shaft activation means 26 and shackle release member 27 are cooperatively mounted in cavity 37 of housing 21. In addition, spring means 53 is mounted in a receiving channel formed in shaft release member 27, with the opposed end of spring means 53 abutting a portion of housing 21 which forms a terminating end of cavity 37.

By employing this construction, shackle release member 27 is continuously biased into engagement with locking notch 54 of shackle 22, normally maintaining shackle 22 in its desired securely locked position. Due to the force of spring means 53 acting upon shackle release member 27, shackle 22 is normally maintained in a securely locked position, incapable of being removed from this locked position until release member 27 has been moved laterally into cavity 37 and out of engagement with locking notch 54.

In order to enable shackle release member 27 to be controllably removed from locking notch 54 whenever the correct combination has been entered on dials 25, shaft activation means 26 is employed. In this embodiment, shaft activation means 26 comprises an elongated, generally cylindrically shaped bar which is longitudinally movable in cavity 37 of housing 21 in an axial direction, generally perpendicular to bore 29 of housing 21. In addition, pin means is mounted in cavity 37 in association with shaft activation means 26 in order to limit and control the longitudinal movement of shaft activation means 26.

With one end of shaft activation means 26 extending outwardly from housing 21 when shackle release member 27 is engaged with locking notch 54 of shackle 22, the movement of shaft activation means 26 towards elongated bore 29 of housing 21 disengages shaft release member 27 from locking notch 54 of shackle 22, enabling shackle 22 to be released and combination lock 20 of the present invention to b opened. However, as detailed herein, shaft activation means 26 is only movable when each dial 25 has been placed in the proper position, displaying the secret combination.

In the preferred construction, shaft 23 comprises a substantially cylindrically shaped intermediate section 57 longitudinally extending over the major length thereof. In addition, shaft 23 incorporates an enlarged head member 58 formed at one end of shaft 23 and positioned for cooperative engagement with shaft activation means 26. As is more fully detailed below, head member 58 preferably incorporates a truncated conical shaped surface 59 formed at the terminating end thereof. Finally, the construction of shaft 23 is completed by preferably incorporating a terminating end section 60 formed at the opposed end of shaft 23 from head member 58. In the preferred embodiment, terminating end section 60 comprises a substantially cylindrical shape having a diameter smaller than the diameter of intermediate section 57.

The construction of combination lock 20 of the present invention is completed by preferably mounting locking washer or spacer 61 at the juncture between intermediate sections 57 and terminating end section 60. Spring means 60 is mounted about terminating end section 60 with one end thereof in contact with locking washer 61.

Finally, the opposed end of spring means 60 contacts plug means 63 formed at the base of elongated bore 28 which effectively closes the end of bore 28. In addition, plug member 63 incorporates an aperture 64 which is dimensioned for receiving and peripherally surrounding terminating end section 60, enabling the axial movement of end section 60 through plug member 63. If desired, housing 21 may be constructed with bore 28 terminating with aperture 64 formed therein, dimensioned to enable terminating end section 60 to pass therethrough. Regardless of which embodiment is employed, substantially equivalent operational constructions are attained.

By employing the preferred construction, with shaft 23 having an overall length greater than the length of bore 28, a portion of shaft 23 extends from housing 21 regardless of the axial position within which shaft 23 is placed. As shown in FIG. 5, when combination lock 20 of the present invention is maintained in its fully engaged and locked position, truncated conical shaped surface 59 of head member 58 of shaft 23 protrudes from bore 28 of housing 21. In addition, shaft activation means 26 is constructed for cooperative interengagement with head member 58 of shaft 23.

In its preferred construction, shaft activation means 26 comprises a first end portion 65 constructed for extending outwardly from housing 21 and a second, opposed end portion 66 positioned for contacting and controllably moving shackle release member 27 and contacting pin 55. Finally, shaft activation means 26 incorporates an intermediate portion 67 which extends between and interconnects first end portion 65 with second end portion 66.

In the preferred embodiment, shaft activation means 26 comprises an overall cylindrical shape, with first end portion 65 and second end portion 66 comprising substantially equal diameters. However, intermediate, interconnecting portion 67 comprises a diameter smaller than the diameter of end portions 65 and 66. In addition, intermediate portion 67 is interconnected with first end portion 65 by a substantially truncated, conical shaped surface 68.

As shown in FIG. 5, when combination lock 20 is in its locked position, with the combination for opening lock 20 not being displayed on dials 25, truncated conical shaped surface 59 of head member 58 of shaft 23 protrudes from bore 28 and is positioned in cooperating, nested, engagement with intermediate interconnecting portion 67 and truncated conical shaped surface 68 of shaft activation means 26. As a result, shaft activation means 26 is incapable of axial movement, since shaft 23 is prevented from movement due to the position of dials 25.

In the preferred construction, shaft 23 is maintained its fully extended position, engaged with shaft activation means 26 by constructing the axial length of intermediate section 57 and head member 58 with the desired dimensions for extending through the length of bore 28 of housing 21. In order to assure that shaft 23 is maintained in position, with truncated conical shaped surface 59 engaged with shaft activation means 26, bore 28 of housing 21 incorporates a ledge 69 for contacting and limiting the axial movement of locking washer 61. By employing this construction, spring means 62 normally maintains locking washer 61 in contact with ledge 69. Simultaneously therewith, locking washer 61 advances and maintains shaft 23 in the desired position, with truncated conical shaped surface 59 protruding from bore 28 and engaged with shaft activation means 26.

By employing the construction detailed above, when combination lock 20 is in its fully engaged and locked configuration, as depicted in FIG. 5, unwanted or unauthorized opening of combination lock 20 is prevented. Due to the cooperative engagement of truncated, conical shaped surface 59 of shaft 23 with intermediate portion 67 and truncated conical shaped surface 68 of shaft activation means 26, axial moment of shaft activation means 26 is prevented since shaft 23 is incapable of axial movement. As a result, shaft activation means 26 is effectively blocked from movement, preventing shaft activation means from being used to remove or dislodge shackle release member 27 from locking notch 54 of shackle 22. Furthermore, by employing this construction, a unique padlock is achieved which prevents known techniques from being used to "pick" prior art combination locks or open such locks without knowledge of the secret combination.

As is more fully detailed below, when each of the dials 25 have been rotated into the correct position for displaying the pre-set, secret combination, shaft 23 is able to axially move in bore 28 of housing 21. However, since spring means 62 maintains shaft 23 in its normally engaged position with shaft activation means 26, an axial force is required to counteract the spring force and cause shaft 23 to move out of engagement with shaft activation means 26.

In view of the use of truncated conical shaped surfaces 59 and 68, the axial movement of shaft activation means 26 causes the sloping surface of truncated conical shaped surface 68 to engage the sloping surface of truncated conical shaped surface 59 of shaft 23, imparting a force to shaft 23 which causes shaft 23 to move against the force of spring means 62 and advance through bore 28 of housing 21. Typically, an external force is applied to shaft activation means 26 by manually pressing the outside surface thereof, causing shaft activation means 26 to advance into housing 21 and simultaneously controllably move shackle release member 27 out of locked engagement with notch 54 of shackle 22.

In addition, as truncated conical shaped surfaces 68 and 59 are brought into engagement with each other, the continued axial movement of shaft activation means 26 into cavity 37 of housing 21 causes truncated conical surface 68 to override truncated conical shaped surface 59 of shaft 23, axially moving shaft 23 downwardly through bore 28, until the larger diameter surface of first portion 65 is in overlying contacting engagement with the terminating end of head member 58 of shaft 23, as depicted in FIG. 7. When in this position, a major portion of terminating end section 60 of shaft 23 extends outwardly from housing 21 through aperture 64 of plug member 63, providing a positive visual signal that combination lock 20 is opened. As is more fully detailed below, this position is also used for setting or re-setting lock 20, thereby providing a positive visual indicator to the user that the proper position is attained as well as the proper entry of a new combination.

Figure 8:
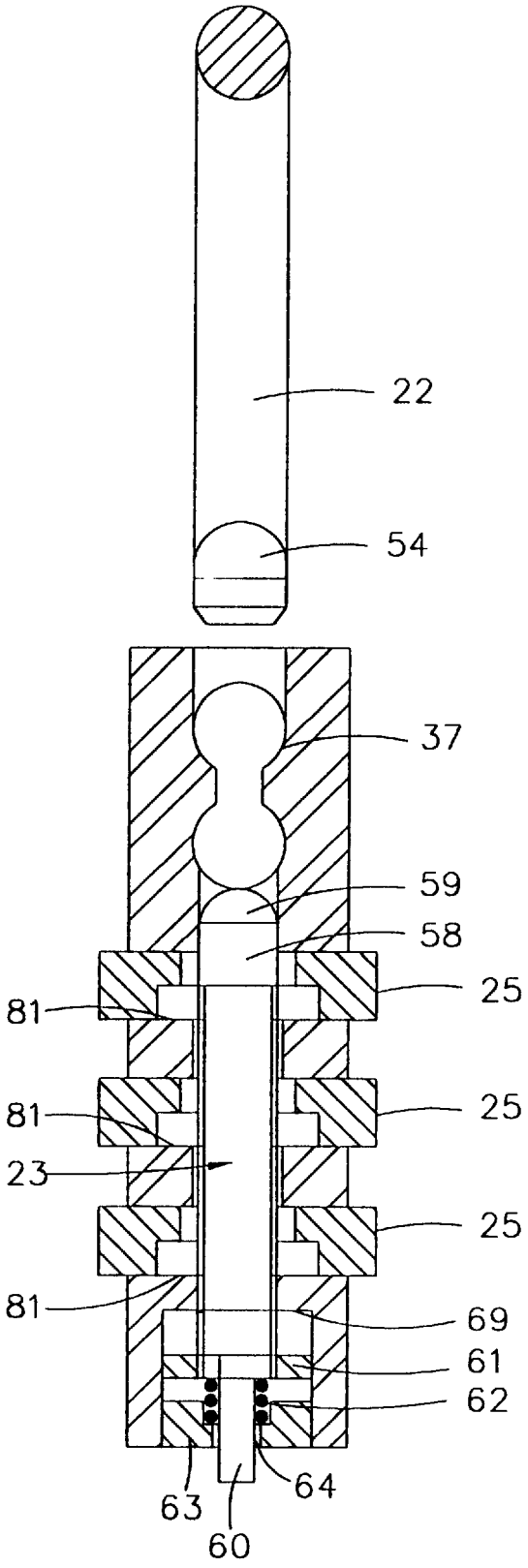
FIG. 8 is a cross-sectional side elevation view taken along line 8—8 of FIG. 7.

As clearly depicted in FIGS. 5, 7 and 8, head member 58 comprises a radially extending ledge 70 at the juncture between head member 58 with intermediate section 57 of shaft 23. In addition, the axial distance between ledge 70 and locking washer 61 is constructed for being substantially equivalent to the axial length required for enabling the three tumbler sleeves 24 to be retained on intermediate section 57 of shaft 23, with each tumbler sleeve 24 being capable of independent rotational movement. In addition, by employing this construction, axial movement of tumbler sleeves 24 is substantially eliminated and tumbler sleeves 24 are able to provide the desired locking and unlocking function, while achieving this result in an easily manufactured and easily assembled construction.

If desired, combination lock 20 of the present invention may also comprise a plurality of sets of pins 76 and springs 77, mounted in a receiving cavity formed in housing 21. Although these components are optional, the preferred embodiment incorporates one pin and spring in direct association with each rotatable dial 25 in order to provide positive position locating means which also produces an audible sound each time the precise position of each numeral on dial 25 is reached.

In the preferred construction, each spring 76 is maintained under compression, forcing each pin 76 into engagement with outer surface 44 of dial member 25. In addition, with each dial member incorporating slots 46 formed between each numeral bearing panel 45, the movement of spring loaded pin 76 into and out of slots 46 causes an audible click, designating the proper orientation of the dial for each numeral. In addition to the audible click produced, the movement of pin 76 into engagement in slot 46 also provides a positive structural indication and rotational stop indicating that one particular numeral is in its proper orientation.

As shown in FIGS. 1–4, a visual indicator of the proper orientation for each numeral of each panel 45 of each dial 25 is also provided by incorporating on housing 21 position orientation line 78. Line 78 enables the user to visually position each numeral in the proper location for the pre-set combination or for setting or re-setting the combination. By employing orientation line 78 along with pins 76 and springs 77, proper orientation of any particular numeral is easily achieved. Furthermore, although orientation line 78 is depicted on the side edge of housing 21, orientation line 78 may be formed on any desired surface of housing 21 in association with dial 25.

In the present invention, bore 28 preferably comprises an upper zone and a lower zone, with the lower zone having a diameter slightly greater than the outside diameter of tumbler sleeves 24. In this way, tumbler sleeves 24 are capable of axial movement through the lower zone of bore 28. In addition, the lower zone of bore 28 also comprises an elongated slot or channel 80 formed in the wall of bore 28, providing the release position for each radially extending fin 30 of each tumbler sleeve 24.

When each locking fin 30 of each tumbler sleeve 24 is aligned with release channel 80, shaft 23 is able to be axially moved by the force imposed thereon by shaft activation means 26. Since the movement of shaft activation means 26 also causes shackle release member 27 to move out of engagement with locking notch 54 of shackle 22, shackle 22 is automatically unlocked and forced out of the upper zone of bore 28 by the force of spring means 50. At that time, the force imposed upon shaft activation means 26 may be removed, enabling shaft activation means 26 and shackle release member 27 to return to the position shown in FIG. 5 due to the force of spring means 53.

When shackle 23 is released from bore 28 and shackle release member 27 is returned to its original position as shown in FIG. 5, combination lock 20 is open for use as well as ready for being relocked, whenever desired. Once a user has secured combination lock 20 to a desired object, shackle 22 is quickly and easily re-engaged into the locked position by merely inserting the free end of shackle 22 into bore 28 and moving shackle 22 into housing 21 until shackle release member 27 is brought into engagement in locking notch 54 of shackle 22.

As is evident from the beveled construction of the free end of shackle 22 and the free end of shackle release member 27, these surfaces are brought into contact with each other as shackle 22 is advanced into housing 21. As this advanced movement continues, shackle release member 27 is initially forced into further engagement with cavity 37 against the force of spring means 53. This movement continues until locking notch 54 is moved downwardly below the leading edge of shackle release member 27. At that time, the force of spring means 53 causes shackle release member 27 to move in the opposite direction, causing the leading edge thereof to enter locking notch 54 and securely lock shackle 22 in housing 21.

In order to assure that each dial 25 is cooperatively associated with a tumbler sleeve 24 and is rotatable about shaft 23 along with its associated tumbler sleeve 24, housing 21 incorporates three separate and independent dial receiving zones 81. Each dial receiving zone 81 is formed in juxtaposed spaced aligned parallel relationship with each other, while also being cooperatively associated with bore 28 and elongated release channel 80. In addition, as detailed above, each dial receiving zone 81 is cooperatively associated with a cavity, within which a spring 77 and a pin 78 are preferably positioned for interengagement with dial 25.

As discussed above, one of the difficulties encountered with prior art combination locks is the ability of some individuals to gain access to a secured lock by using known picking techniques. The principal technique employed is to apply pressure to the shackle while individually rotating the dials and listening for a known clicking sound which occurs whenever the locking fin or bar of the tumbler sleeve enters the release channel associated with that tumbler. By continuously repeating this process, a secured lock is capable of being unlocked even though the individual does not know the actual combination for that lock. However, by employing the present invention, this procedure is completely thwarted, since the locking system is associated with only shaft 23 and direct access to shaft 23 is prevented. As a result, the present invention virtually eliminates unwanted opening of the lock using conventional prior art techniques.

By referring to FIGS. 7 and 8, along with the following detailed disclosure, the combination resetting functions of combination lock 20 of the present invention can best be understood. In FIG. 7, combination lock 20 is depicted in its unlocked position. As detailed above, in order to attain the unlocked position, each dial 25 must be rotated to the precise location wherein radially extending fin 30 of each tumbler sleeve 24 is aligned with release channel 80. Once each radially extending fin 30 is positioned within release channel 80 of bore 28, shaft 23 is capable of being axially moved downwardly against the force of spring means 62 by the axial movement of shaft activation means 26.

As is evident from FIGS. 5 and 7, when shaft 23 is initially axially moved downwardly, each radially extending fin 30 of each tumbler sleeve 24 enters a portion of release channel 80 of bore 28 of housing 21, while still being within slot 35 of dial 25. Since release channel 80 is constructed with dimensions which are slightly greater than radially extending fin 30, fin 30 of each tumbler sleeve 24 is able to easily enter channel 80. However, rotational movement of tumbler sleeve 24 or dial 25 is prevented, since each tumbler sleeve 24 is effectively locked in channel 80 and slot 35. As a result, rotational movement of dial 25 is also prevented.

As discussed above, when combination lock 20 is in the open position with shackle 22 forced out of engagement in the upper zone of bore 28, shackle 22 is free to pivot about the central axis of bore 29. As a result, the free rotational movement of shackle 22 is attained, and a user is able to mount shackle 22 with any desired object for securely closing and effectively locking the object once shackle 22 has been pivoted back to engagement with shackle release member 27 in bore 28 of housing 21.

As clearly shown in FIG. 7, when shaft 23 is axially moved downwardly to its maximum extent, with first end portion 65 of shaft activation means 26 substantially fully engaged in housing 21, each fin 30 of each tumbler sleeve 24 is advanced into channel 80 of bore 28 of housing 21 into a position wherein each radially extending fin 30 of each tumbler sleeve 24 is fully disengaged from slot 35 of each dial 25. As a result, although tumbler sleeves 24 are incapable of being rotationally moved, due to the secure interengagement of fin 30 with channel 80, each dial 25 is free to rotate about the axis defined by shaft 23 since fin 30 has been completely disengaged from each dial 25. In this way, any desired numeral can be aligned with position orientation line 79, thereby enabling the user to select any desired combination of numbers to represent the particular combination for opening lock 20.

Once dials 25 have been arranged into the numerical sequence desired by the user to form the opening combination for lock 20, the user's activation force is removed from first end portion 65 of the shaft activation means 26, causing shaft activation means 26 to be forced by spring means 53 into its original position, depicted in FIG. 5. Simultaneously therewith, shaft 23 is forced upwardly by spring means 60 to its original position, in nested, locked interengagement with shaft activation means 26. Once in this position, dials 25 are easily rotated into any desired position, causing locking fins 30 of each tumbler sleeve 24 to be moved out of alignment with release channel 80. Once in this position, combination lock 20 is securely locked to the desired product, with the precisely desired preset combination effectively entered into lock 20 as the only sequence for opening lock 20.

As shown in FIGS. 7 and 8, when shaft activation means 26 is fully engaged with housing 21 due to the position of an activation force on first end portion 65, terminating end section 60 of shaft 23 protrudes from aperture 64 of plug member 63. In this way, a positive visual indicator is provided to the user informing the user that shaft 23 is in the desired position for enabling dials 25 to be reset in any desired sequence for establishing a new opening combination for lock 20.

In addition, by employing the construction of the present invention, a positive indicator is also provided to the user whenever dials 25 are not placed in the proper position or orientation for designating a new combination identifier or numeral. In this regard, when a new combination sequence is entered into lock 20, the desired sequence is aligned along position orientation line 79. As detailed above, when this sequence has been properly entered, shaft 23 returns to its original engaged position with shaft activation means 26, once the holding force has been removed from shaft activation means 26.

If any dial 25 is rotated into a position between two indicia bearing panels 45, the desired new numerals or indicia numeral is not selected or designated by the user. In this instance, radially extending locking fin 30 of tumbler sleeve 24 is positioned between two slots 35 of dial 25, which prevents shaft 23 from being returned to its original position by the force of spring means 62. As a result, in this situation, terminating end section 60 remains outwardly extended from aperture 64 of housing 21, providing the user with a positive visual indicator that the desired numerical or indicia sequence is improperly displayed and incapable of valid entry into combination lock 20. Once this positive visual indicator observed by the user, the error is easily corrected and the desired combination is properly set for opening lock 20.

By employing this embodiment of the present invention, the user is provided with a further improvement and enhanced construction, imparting added convenience and benefits to the user for preventing unwanted errors from occurring and assuring the user is able to employ the combination lock of the present invention with consistency and reliability.

As is evident from the foregoing detailed disclosure, by employing the present invention, a uniquely constructed combination lock is attained which provides all of the desired functions of a combination lock in a highly effective, easily assembled and easily employed construction capable of being produced with substantially greater ease and convenience. Furthermore, the construction of the present invention incorporates a construction which separates the shackle from the locking system, thereby effectively attaining a combination lock which virtually eliminates unauthorized individuals from gaining access to the combination lock, when in its locked position, using conventional picking techniques.

Furthermore, the combination lock of the present invention incorporates a virtually sealed construction which eliminates unwanted debris from entering the rotating mechanisms of the combination lock. As a result, interference of these rotating components with environmental debris is virtually eliminated and a combination lock is attained which is capable of providing long-term use, free from interference or destruction by environmental contamination.

Figure 4:
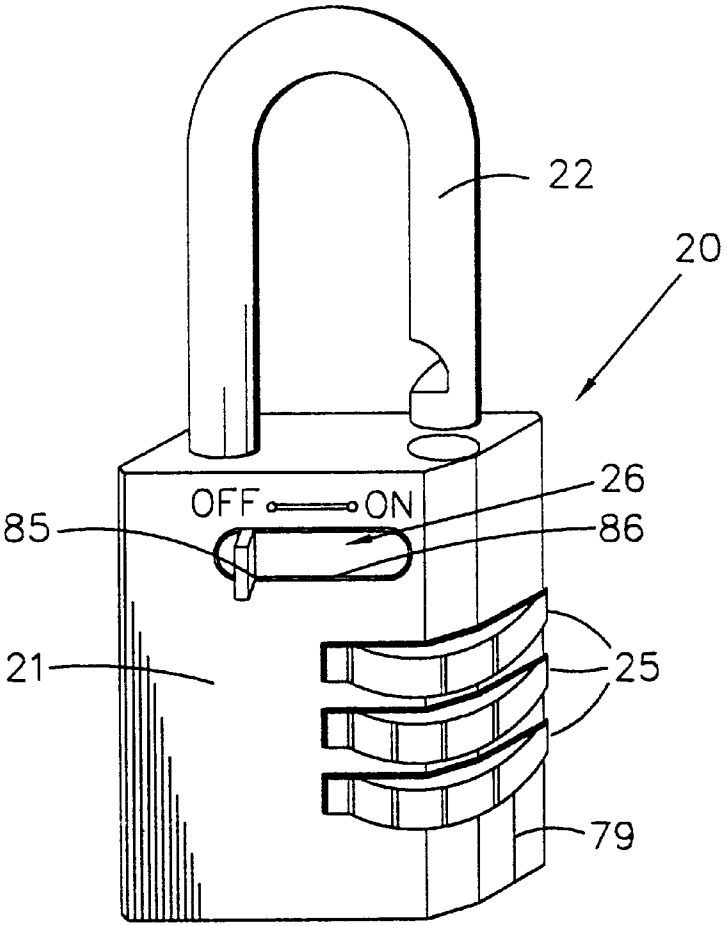
FIG. 4 is a perspective view of the combination lock of FIG. 3 shown in its open, unlocked position.
Figure 3:
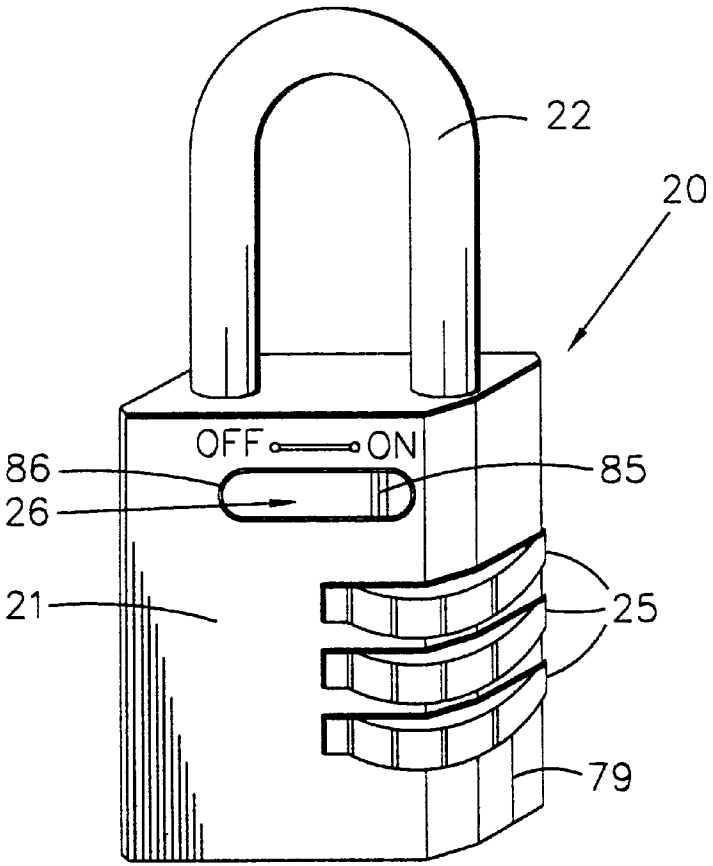
FIG. 3 is a perspective view of an alternate embodiment oft he combination lock of the present invention shown fully assembled and in its locked position.

In addition to employing the preferred construction detailed above, the present invention can also be implemented using alternate constructions. One such construction, depicted in FIGS. 3 and 4, is easily employed without deviating from the scope of the present invention.

In this alternate embodiment, shaft activation means 26 is constructed incorporating a post or lever 85 as the portion thereof extending outwardly from housing 21, with lever 85 cooperatively associated with elongated slot 86 formed in one wall of housing 21. The remainder of shaft activation means 26 is constructed in a manner substantially identical to the construction detailed above and shown in FIGS. 5–8. In addition, controlled movement and interaction of shaft release member 27 and shaft 23 is substantially identical to the construction detailed above, with lever 85 representing the single portion of shaft activation means 26 which extends outwardly through housing 21.

In this alternate embodiment of the present invention, lever 85 is movable between two alternate positions whenever the precisely desired combination has been entered on dials 25. In the first, normally locked position, depicted in FIG. 3, shackle 22 is securely locked with housing 21, with lever 85 incapable of movement in slot 86 of housing 21. However, once the precisely desired, pre-set combination has been entered on dials 25, lever 85 is movable from its first position to its second position, depicted in FIG. 4. Once lever 85 is moved from its first position to its second position, shackle release member 27 is simultaneously moved therewith, causing shackle 22 to be released and automatically forced out of housing 21 by spring means 50.

As is evident from this detailed disclosure, the overall construction and operation of this embodiment of combination lock 20 is substantially identical to the alternate embodiment of the present invention detailed above. In this embodiment, alternate means for releasing shackle 22 from locked engagement with shackle release member 27 is provided.

This variation, as well as other variations, can be incorporated into combination lock 20 of the present invention without departing from the scope of the present invention. Consequently, it is intended that all such variations form a part of this invention and are within the scope of this invention.

It will thus be seen that the objects set forth above, among those made apparent from the preceding description are efficiently attained and, since certain changes may be made in the above article without departing from the scope of this invention, it is intended that all matter contained in this disclosure or shown in the accompanying drawings, shall be interpreted as illustrative and not in a limiting sense.

It is also to be understood that the following claims are intended to cover all of the generic and specific features of the invention herein described and all statements of the scope of the invention which as a matter of language, might be said to fall therebetween.

Having described my invention, what I claim as new and desire to secure by Letters Patent is:

1. A combination lock constructed for ease of use, while also substantially eliminating the ability of unauthorized persons from opening the lock without knowledge of the combination, said combination lock comprising:

(A.) a housing incorporating
a first elongated bore,
a plurality of dial receiving zones formed in the housing, with each of said receiving zones extending substantially perpendicularly to the axis of the first bore,
an elongated release channel formed in the first bore and axially extending therewith, said elongated release channel defining a zone for enabling the opening of the combination lock, and
a holding cavity cooperatively associated with the first bore;

(B.) a shackle cooperatively associated with the housing and comprising a locking notch formed at one terminating end of the shackle and constructed for cooperative locking and unlocking interengagement with a movable shackle release member;

(C.) an elongated shaft
mounted in the elongated bore, and
axially movable between a first position wherein a first end portion of the shaft extends outwardly from the bore into the holding cavity, and an end position wherein the first end portion is contained within the first bore;

(D.) a plurality of tumbler sleeves, each of said tumbler sleeves
rotationally mounted to the shaft for rotational movement about the central axis thereof, and
incorporating a radially extending fin formed on the outside surface thereof and constructed for cooperative association with the elongated release channel for preventing axial movement of the shaft as well as enabling axial movement thereof when each of said radial fins are positioned in the elongated release channel;

(E.) a plurality of dials each of said dials
mounted in a dial receiving zone of the housing,
peripherally surrounding a tumbler sleeve for cooperating therewith, and
comprising an inside surface formed by a tumbler locking surface and a tumbler release surface; and (F.) a shackle release member movably mounted in the holding cavity of the housing and comprising
a shaft interfacing zone constructed for receiving and retaining the first end of the shaft when the shaft is in its first position and controllably moving the shaft into its second position, and
locking means constructed for engaging the notch of the shackle and maintaining the shackle in a locked position when desired and disengaging from said notch for unlocking the shackle when desired.

2. The combination lock defined in claim 1, wherein said shackle release member is further defined as being movable between a first position wherein said shackle is securely locked in the housing and a second position wherein the shackle is unlocked and freely movable relative to the housing and the movement of the shackle release member between its two positions is controlled by the position of the plurality of tumbler sleeves relative to the elongated release channel and the control of said tumbler sleeves on the axial movability of said shaft, whereby the shackle release member is incapable of being moved from its first position to its second position whenever the shaft is in its first position and the radially extending fins of the tumbler sleeves are not aligned with the elongated release channel of the first elongated bore.

3. The combination lock defined in claim 2, and further comprising (G.) first biasing means mounted in the holding cavity of the housing in cooperating association with the shackle release member for normally maintaining the shackle release member in its first position, requiring an activation force for moving the shackle release member from its first position to its second position.

4. The combination lock defined in claim 3, wherein said shackle release member is further defined as comprising an activation control portion extending out of the housing for enabling an activation force to be imposed thereon.

5. The combination lock defined in claim 4, wherein said activation control portion comprises a push button extending from the housing in a position for easy access and use.

6. The combination lock defined in claim 4, wherein said activation control portion comprises a lever arm extending from the housing and positioned in an elongated slot which defines the movability thereof.

7. The combination lock defined in claim 2, wherein the housing further comprises a second elongated bore formed therein substantially parallel to the first elongated bore and the shackle is further defined as comprising a generally J-shape, with the longer leg thereof mounted in the second elongated bore for axial movement therein.

8. The combination lock defined in claim 7, and further comprising second biasing means mounted in the second elongated bore in cooperating association with the longer leg of the shackle for axially moving the shackle relative to the housing when the shackle is unlocked.

9. The combination lock defined in claim 2, wherein said first end of said elongated shaft is further defined as comprising an enlarged head portion terminating with a beveled surface.

10. The combination lock defined in claim 9, wherein said first elongated bore is further defined as comprising a shackle receiving zone and a shaft receiving zone co-axially aligned with each other, with said shaft receiving zone having a first portal communicating with the holding cavity of the housing and a second portal formed at the opposed end thereof.

11. The combination lock defined in claim 10, and further comprising third biasing means cooperatively associated with the shaft for normally maintaining the shaft in its first position with the head portion thereof extending outwardly from the shaft receiving zone of the first elongated bore into the holding cavity.

12. The combination lock defined in claim 11, wherein said shaft interfacing zone incorporates a beveled surface cooperatively associated with the beveled surface of the enlarged head portion of the shaft for preventing movement of the shackle release member when the shaft is locked and assisting in axially moving the shaft into the receiving zone of the first elongated bore when the shaft is unlocked.

13. The combination lock defined in claim 10, wherein said shaft is further defined as comprising an overall length greater than the axial distance between the first portal and the second portal of the shaft receiving zone of the first elongated bore.

14. The combination lock defined in claim 13, wherein said shaft comprises an extension portion formed at the second end thereof, said extension portion protruding from the second portal of the shaft receiving zone of the first elongated bore whenever the shaft is in its second position, thereby providing a positive visual indicator that the shaft is in its second position.

15. The combination lock defined in claim 1, wherein each of said dials is further defined as comprising a generally cylindrical shape having a plurality of indicia bearing panels on an outer surface thereof for establishing readily identifiable indicia which define elements usable as the combination for defining the release mode of the lock.

16. The combination lock defined in claim 15, wherein each of said dials is further defined as comprising a slot formed on the outer surface thereof between each adjacent indicia bearing panel.

17. The combination lock defined in claim 16, wherein said housing is further defined as comprising a cavity directly adjacent each dial receiving zone and the combination lock is further defined as comprising a spring and pin member mounted in each cavity for cooperating interengagement with each dial, providing a positive indicator for designating the position of the rotating dial and indicating when each panel is in a desired orientation for designating an element of the combination.

18. The combination lock defined in claim 1, wherein each of said tumbler sleeves is essentially incapable of translational movement along the axis of the shaft.

19. The combination lock defined in claim 1, wherein the tumbler locking surface of each dial is further defined as comprising a plurality of radial slots formed therein constructed for cooperating interengagement with the radially extending fin of the tumbler sleeve to assure secure, controlled, cooperative interengagement therewith and simultaneous rotation of the tumbler sleeve with the dial when the fin of the tumbler sleeve is engaged with any radial slot of the dial.

20. The combination lock defined in claim 19, wherein the radially extending fin of each tumbler sleeve is further defined as comprising a longitudinal dimension substantially equivalent to the longitudinal width of the dial, thereby assuring interengagement of the radially extending fin and a radial slot of the dial when the combination lock is in the secured and locked position, thereby providing the ability of both the dial and the tumbler sleeve to freely rotate relative to the axis of the long leg of the shackle.

21. The combination lock defined in claim 20, wherein the shaft, with the plurality of tumbler sleeves mounted thereto and positioned in the elongated release channel, is capable of axial movement within the elongated first bore relative to the plurality of dials to effectively remove the radially extending fin of the tumbler sleeves from cooperating interengagement with the tumbler locking surface of the dial, thereby enabling the dial to rotate about the axis of the shackle independently of the tumbler sleeves, allowing any desired indicia bearing panel of the dials to be positioned for selecting desired elements to define the release combination.

* * * * *